United States Patent [19]

Thurber

[11] Patent Number: 4,569,144

[45] Date of Patent: Feb. 11, 1986

[54] HANDGUN SAFETY DEVICE

[76] Inventor: Russell Thurber, 5757 Butte Falls Hwy., Eagle Point, Oreg. 97524

[21] Appl. No.: 654,399

[22] Filed: Sep. 26, 1984

[51] Int. Cl.[4] ..... F41C 27/00

[52] U.S. Cl. ..... 42/1 LP

[58] Field of Search ..... 42/1 LP

[56] References Cited

U.S. PATENT DOCUMENTS 3,022,598 2/1962 Wikstrom ..... 42/1 LP 4,412,397 11/1983 Bayn ..... 42/1 LP

*Primary Examiner*—Charles T. Jordan

*Attorney, Agent, or Firm*—Jeffrey J. Blatt

[57] ABSTRACT

A firing safety device for handguns is disclosed. The device prevents the accidental discharge of the gun by children and is easily removeable by adults thereby resulting in the gun being ready for use almost immediately. The device includes a rod which is inserted into the gun barrel and into the cartridge chamber thereby preventing the cylinder from revolving. The rod is held in position by a cable which loops around the back of the gun. The device is removeable by inserting manual pressure to a cap at the front of the rod, which depresses a spring and releases the tension on the cable.

20 Claims, 6 Drawing Figures

HANDGUN SAFETY DEVICE

BACKGROUND OF THE INVENTION

1. Field of the Invention

The present invention relates to the field of safety devices for handguns, and more particularly, to devices for the prevention of accidental discharge of handguns.

2. Art Background

The unintentional discharge of a handgun has been a source of needless injury for many years. Children playing with guns found in a parent's belongings have been injured or killed at an alarming rate due to accidental firings. Numerous attempts have been made to "neuter" or otherwise render a firearm inoperative in order to prevent accidental firings. In most cases, attempts to prevent accidental discharge require that the firearm be rendered inoperable or maintained in an unloaded condition. Accordingly, any attempt to use the firearm for protection requires the user to reassemble or load the gun under possibly adverse conditions.

As will be described, the present invention provides a safety lock device having particular application for use with handguns, which effectively prevents non-intended users, such as children, from operating the firearm. Although children are prevented from discharging the weapon, an adult may quickly disengage the present invention from the handgun and operate the firearm as intended. As will be appreciated, although the present invention is designed primarily for use with revolvers, its teachings may be applied to semiautomatic or automatic pistols as well as other firearms.

SUMMARY OF INVENTION

The present invention is a firing safety device for handguns and is designed to prevent accidental discharge of a gun. The gun cannot be discharged with the safety device in position; however the device can be removed quickly by exertion of manual pressure. A rod is inserted into the barrel of the gun and partway into the cartridge chamber. The rod prevents the cylinder of the gun from revolving in the case of a revolver, and in the case of an automatic, the rod prevents the slide from moving and a cartridge from a loading clip to be introduced into the chamber. The rod screws into a rounded pressure cap, to which is attached a compression spring. The spring encircles the rod and carries at its lower end a washer-like plate which rests against the muzzle of the gun. The rod is kept in position by a cable which attaches to each side of the pressure cap, and loops over the hammer or the rear of the gun. When the present invention is in place, the compression spring is at its compressed position and keeps the cable taut. The application of manual pressure to the cap by pushing it against a hard object further depresses the spring, which releases the cable and the rod can then be removed. Alternatively, if an optional automatic release method is used, an ejection spring ejects the rod. The gun is then ready for firing.

The first primary object of the invention is to provide a firing safety device to prevent the accidental discharge of the gun, especially by children. The device, due to the amount of force required to depress the spring, cannot be removed by children under 9 years or so or persons weighing less than sixty-five pounds.

The second primary object of the invention is to provide a safety device which can be removed quickly by adults, allowing the gun to be fired almost immediately.

DETAILED DESCRIPTION OF THE INVENTION

The present invention is a firing safety device for handguns designed to prevent accidental discharges, especially by children. In the following description, for purposes of explanation, specific materials and configurations are set forth in order to provide a thorough understanding of the present invention. However, it will be apparent to one skilled in the art that the present invention may be practiced without these specific details.

Figure 1:
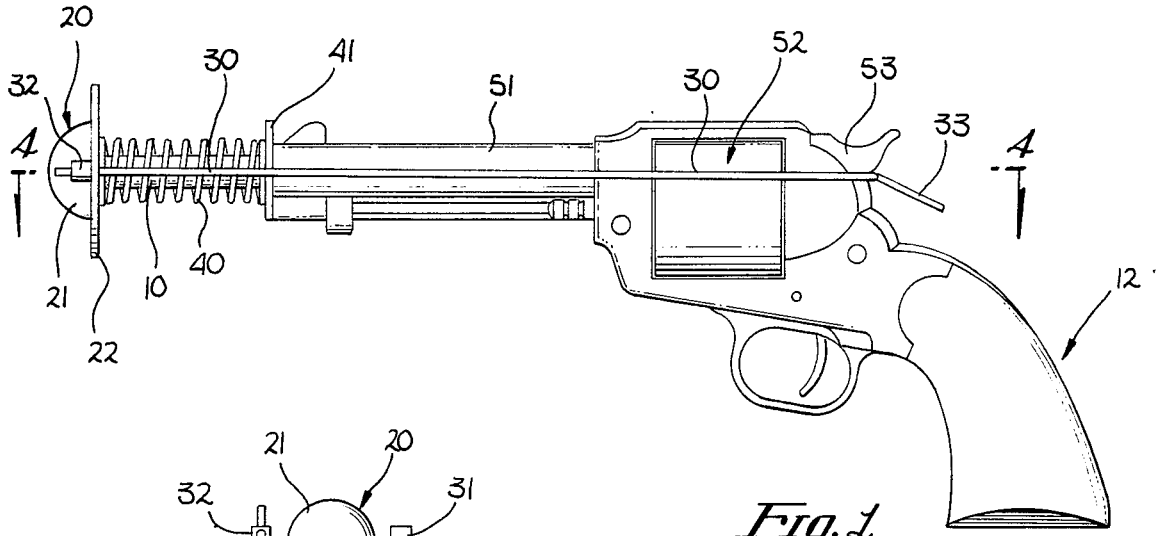
FIG. 1 is a side view of a handgun with the firing safety device in position.

Referring to FIG. 1, the present invention includes a rod 10 which is inserted into the barrel 51 of a handgun 12. The rod is made of a lightweight metal or material such as, for example, steel, aluminum or the like. Its diameter accomodates the bore size of the barrel 51, and its length, which is adjustable, permits insertion for the full length of the barrel 51 plus penetration (of about one-half inch) into the cartridge chamber 52 of the handgun. As will be described, the present invention may be used with other types of handguns, such as semi-automatics.

Figure 4:
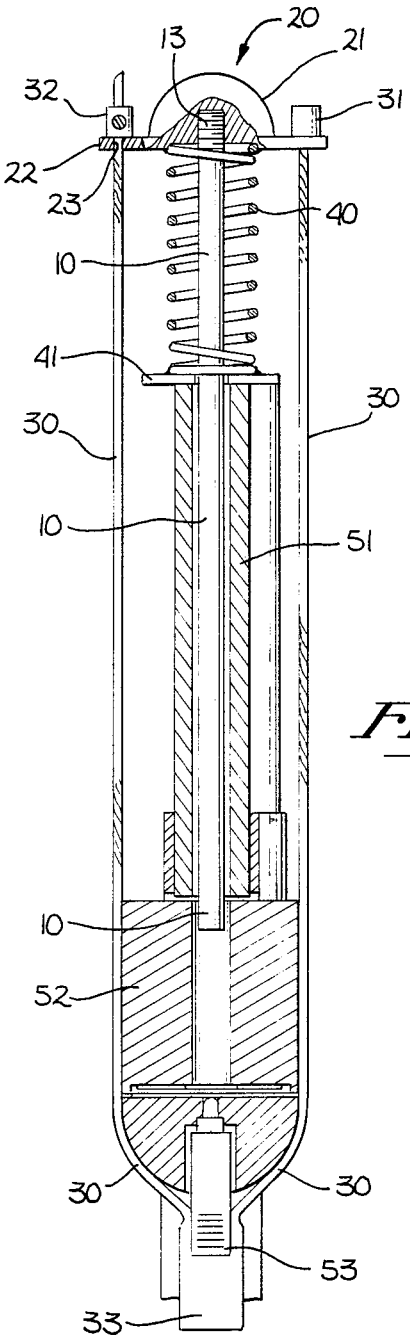
FIG. 4 is a cross-sectional view looking down on the gun and the device.

As best shown in FIG. 4, the outer end of the rod 10 screws into a pressure cap 20. The cap 20, made of comparable material to that of the rod 10, has a rounded head portion 21 and a flat circular base 22 through which a cable 30 passes. Compression spring 40 coils around that portion of the rod 10 remaining outside the gun barrel 51. Spring 40 is attached by spot weld to the base 22 of the pressure cap, and to a steel plate 41 of washer shape and design. The washer-like plate 41 has a thickness of about one-eighth of an inch and a diameter somewhat smaller than the base 22 of the pressure cap 20. The plate 41 has a hole at its center large enough to accomodate the rod 10, and rests against the muzzle of gun barrel 51 when the device is in place. Alternatively, if an optional ejection spring is used, the plate 41 will rest against a separate collar placed in the same position.

Figure 2:
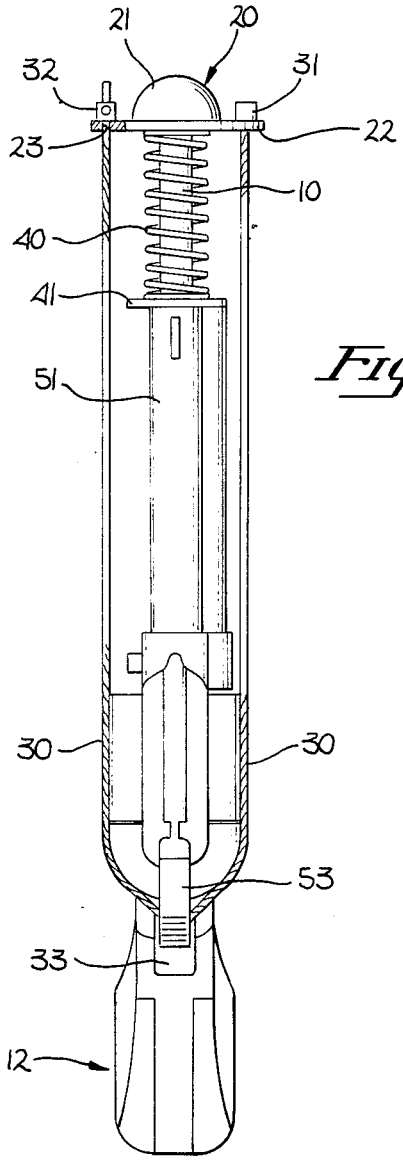
FIG. 2 is a top view of a handgun with the firing safety device in position.

Referring now to FIG. 2, in the present embodiment the flat circular base 22 of the pressure cap 20 is about three-eighths of an inch in width and one-eighth of an inch thick. The base 22 consists of a projecting circular flange which extends the base diameter of the cap to provide added strength and protection, and also to furnish space for two eyelets 23 through which the cable 30 passes.

Figure 3:
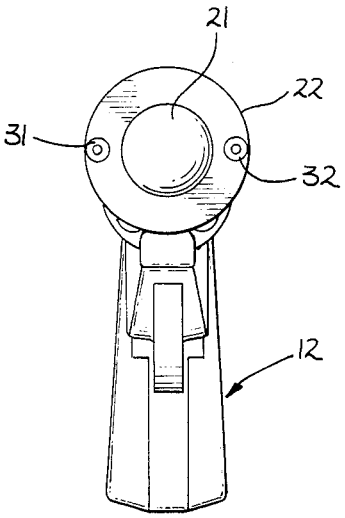
FIG. 3 is a front view of a handgun with the firing safety device in position.

The cable 30, made of woven steel, nonstretchable nylon or of comparable material, is attachable through and by means of the eyelets 23. The cable 30 carries at one end a stop 31 preventing it from being pulled through the eyelet when under tension. The free end of the cable 30 passes through the other eyelet and is held in adjustable position by a squeeze clamp 32. A sliding tab or pull 33 on the cable 30 provides a finger grip for looping the cable 30 over the gun hammer 53 of the handgun 12. FIG. 3 shows the positioning of the eyelets 23 in the base 22 of the pressure cap 20.

Referring now to FIG. 4, the rod 10 extends through the length of the gun barrel and partway into the cartridge chamber 52. The outer end 13 of the rod is threaded to screw into a threaded hole in the center of the cap 20. With the rod in position, the cylinder of the gun cannot revolve and allow the hammer 53 to move or the next cartridge to be introduced.

Figure 5:
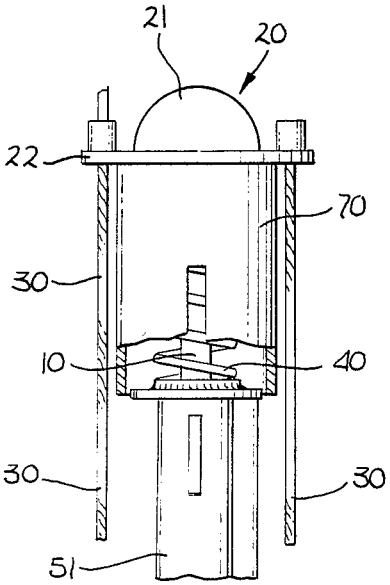
FIG. 5 is a partial sectional top view showing the housing which protects the inner parts of the present invention.

With reference now to FIG. 5, a housing or hood 70 is illustrated which may be used to surround the compression spring 40. Although the hood 70 is not essential to the operation of the device, it improves its appearance and provides protection to inner parts against dirt and denting.

Figure 6:
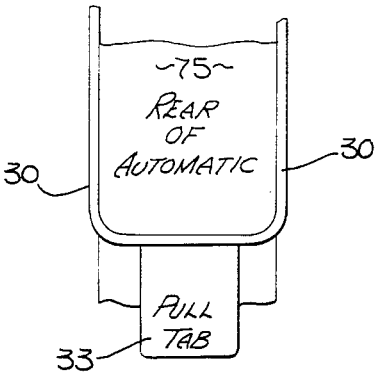
FIG. 6 is a top view of the positioning of the device on the back of an automatic as opposed to a revolver with a hammer.

Referring now to FIG. 6, if the gun to be secured is an automatic, or if the hammer is of a type that affords no holding point or catch for the cable 30, the cable can be caught and held against the flat rear face of the cartridge chamber or slide 75 of the weapon.

To release the present invention and fire the weapon (referring back to FIGS. 1 and 2), the pressure cap 20 must be pressed against a hard object. The spring 40 will be compressed, thereby releasing the tension on cable 30. The cable can then be removed from the handgun by slipping it over the hammer 53, and the present invention can be flipped away by hand, leaving the gun ready for firing. Alternatively, if the optional mechanical ejection means is adopted, then the thrust of the ejection spring(s) will throw off the device once the cable is removed.

While the present invention has been particularly described with reference to FIGS. 1 through 6, and with primary emphasis on handguns, it should be understood that the figures are for illustration only and should not be taken as limitation upon the invention. It is contemplated that many changes and modifications may be made, by one of ordinary skill in the art, to the materials and arrangements of elements of the invention without departing from the spirit and scope of the invention.

I claim:

1. A device for preventing the discharge of a firearm; said firearm having a barrel and a cartridge chamber; and including firing means for discharging a cartridge disposed in said cartridge chamber, comprising:

a rod including an inner and an outer end disposed in and extending through said barrel;

spring means coupled to said rod for applying force to the outer end of said rod;

and cable means for coupling said spring means to said firing means thereby maintaining said rod in said barrel;

whereby the discharge of said firearm is prevented.

2. The device as defined by claim 1, wherein said outer end of said rod extends out of the muzzle of said barrel.

3. The device as defined by claim 2, wherein said spring means includes:

a compression cap;

a pressure plate disposed against said muzzle of said barrel;

a compression spring disposed between said compression cap and said pressure plate.

4. The device as defined by claim 3, further including a sleeve surrounding said compression spring.

5. The device as defined by claim 3, wherein said cable means includes a cable having free ends, said free ends of said cable being retained by said spring means.

6. The device as defined by claim 5, wherein said cable is adjustable in length.

7. The device as defined by claim 5, wherein said cable passing around said firing means restrains operation of said firearm from discharging.

8. The device as defined by claim 7, wherein said firing means includes a hammer; said hammer being restrained from movement by said cable passing around said hammer, thereby preventing the discharge of said firearm.

9. The device as defined by claim 7, wherein said firearm is a revolver, said rod penetrates into a cylinder of said revolver, preventing rotation of said cylinder, thereby preventing discharge of said firearm.

10. The device as defined by claim 7, wherein said firing means includes a sliding mechanism, said sliding mechanism being restrained from movement by said cable passing around said sliding mechanism, thereby preventing the discharge of said firearm.

11. The device as defined by claim 7, further including a pull tab attached to said cable.

12. A firearm safety device for preventing discharge of a firearm, comprising:

a firearm having a barrel and cartridge chamber; said firearm including firing means for discharging a cartridge disposed in said cartridge chamber;

a rod including an inner and an outer end, said inner end disposed in and extending through said barrel and said outer end extending out of the muzzle of said barrel;

spring means coupled to said rod for applying force to said outer end of said rod;

and cable means for coupling said spring means to said firing means;

thereby preventing discharge of said firearm.

13. The device as defined in claim 12, wherein said spring means includes:

a pressure plate disposed against said muzzle of said barrel, said pressure plate containing a central orifice through which said rod passes;

a compression cap disposed against said outer end of said rod, said compression cap containing a flange around its outer periphery;

a compression spring disposed between said compression cap and said pressure plate.

14. The devices as defined by claim 13, wherein said outer end of said rod threads into said compression cap.

15. The device as defined by claim 13, wherein said cable means includes a cable having free ends, said free ends of said cable terminating on opposite sides of said flange of said compression cap.

16. The device as defined by claim 15, wherein said cable is adjustable.

17. The device as defined by claim 15, wherein said firing means includes a hammer, said cable passing around said hammer thereby preventing the discharge of said firearm.

18. The device as defined by claim 15, wherein said firing means includes a sliding mechanism, said cable passing around said sliding mechanism thereby preventing the discharge of said firearm.

19. The device as defined by claim 18, further including a pull tab attached to said cable.

20. A device for preventing the discharge of a firearm; said firearm having a barrel and a cartridge chamber; and including firing means for discharging a cartridge disposed in said cartridge chamber, comprising:

a rod including an inner and an outer end disposed in and extending through said barrel;

spring means coupled to said rod for applying force to the outer end of said rod;

and cable means for coupling said spring means to said firearm, thereby maintaining said rod in said barrel;

whereby the discharge of said firearm is prevented.

* * * * *